US008516764B2

(12) United States Patent
Shige et al.

(10) Patent No.: US 8,516,764 B2
(45) Date of Patent: Aug. 27, 2013

(54) FLOOR TYPE MULTI-DISPLAY APPARATUS AND FLOOR STRUCTURE FOR INSTALLATION OF A FLOOR TYPE MULTI-DISPLAY APPARATUS

(75) Inventors: Daisuke Shige, Osaka (JP); Yoshikazu Harada, Nara (JP); Takashi Makiura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 100 days.

(21) Appl. No.: 13/215,781

(22) Filed: Aug. 23, 2011

(65) Prior Publication Data

US 2012/0042586 A1 Feb. 23, 2012

(30) Foreign Application Priority Data

Aug. 23, 2010 (JP) ..... 2010-185953

(51) Int. Cl.
*E04B 5/00* (2006.01)

(52) U.S. Cl.
USPC ..... 52/506.06; 52/173.1; 52/308; 52/712

(58) Field of Classification Search
USPC ..... 52/712, 173.1, 177, 306, 403.1, 181, 52/308, 480, 506.01, 506.06, 506.08, 263
See application file for complete search history.

(56) References Cited

U.S. PATENT DOCUMENTS

| | | | | | |
|---|---|---|---|---|---|
| 1,818,299 | A | * | 8/1931 | Bowman | 52/335 |
| 1,913,342 | A | * | 6/1933 | Schaffert | 52/588.1 |
| 2,457,619 | A | * | 12/1948 | Yoeum | 62/235 |
| 3,752,974 | A | * | 8/1973 | Baker et al. | 362/627 |
| 4,303,969 | A | * | 12/1981 | Hamilton et al. | 362/153 |
| 4,329,739 | A | * | 5/1982 | Loebner | 362/153 |
| RE33,220 | E | * | 5/1990 | Collier | 52/263 |
| 4,922,670 | A | * | 5/1990 | Naka et al. | 52/126.6 |
| 4,999,964 | A | * | 3/1991 | Taylor | 52/477 |
| 5,046,294 | A | * | 9/1991 | Platt | 52/506.06 |
| 5,333,423 | A | * | 8/1994 | Propst | 52/126.6 |
| 5,389,737 | A | * | 2/1995 | Kobayashi et al. | 174/483 |
| 5,465,534 | A | * | 11/1995 | Mittag | 52/126.6 |
| 5,634,309 | A | * | 6/1997 | Polen | 52/392 |
| 5,681,105 | A | * | 10/1997 | Nau | 362/153 |
| 5,711,118 | A | * | 1/1998 | Molnar | 52/177 |
| 5,715,636 | A | * | 2/1998 | Taylor | 52/308 |
| 5,901,515 | A | * | 5/1999 | Chen | 52/263 |
| 6,256,952 | B1 | * | 7/2001 | Fahy et al. | 52/263 |

(Continued)

FOREIGN PATENT DOCUMENTS

| | | |
|---|---|---|
| JP | 2005-528658 A1 | 9/2005 |
| JP | 2007-275422 A | 10/2007 |

*Primary Examiner* — William Gilbert
*Assistant Examiner* — James Ference
(74) *Attorney, Agent, or Firm* — Edwards Wildman Palmer LLP; David G. Conlin; George N. Chaclas

(57) ABSTRACT

A floor type multi-display apparatus includes a multi-display, transparent panels, and a plurality of support members. The multi-display includes a plurality of displays. The support members include first support members disposed between adjacent ones of the displays in a scattered fashion, and second support members disposed around the multi-display. The support members have respective plate portions positioned along and closely to edges of the displays. The support portion and the base portion of each of the first support members project toward two displays located closely thereto from the plate portion of the first support member. The support portion and the base portion of each of the second support members project toward only one display located closely thereto from the plate portion of the second support member.

4 Claims, 14 Drawing Sheets

(56) References Cited

U.S. PATENT DOCUMENTS

| | | | | |
|---|---|---|---|---|
| 6,427,400 | B1 * | 8/2002 | Greenblatt | 52/220.5 |
| 6,732,478 | B1 * | 5/2004 | Russell et al. | 52/28 |
| 6,851,236 | B1 * | 2/2005 | Harvey | 52/403.1 |
| 7,181,889 | B2 * | 2/2007 | Perkowski et al. | 52/177 |
| 2002/0026757 | A1 * | 3/2002 | Scissom et al. | 52/220.2 |
| 2003/0097808 | A1 * | 5/2003 | Sabatini | 52/384 |
| 2004/0240230 | A1 * | 12/2004 | Kitajima et al. | 362/558 |
| 2005/0028463 | A1 * | 2/2005 | Pantev | 52/263 |
| 2005/0102943 | A1 * | 5/2005 | Voegele | 52/506.01 |
| 2005/0193660 | A1 * | 9/2005 | Mead | 52/263 |
| 2005/0235589 | A1 * | 10/2005 | Jakob-Bamberg et al. | 52/263 |
| 2005/0246984 | A1 * | 11/2005 | Colosimo et al. | 52/263 |
| 2006/0192683 | A1 * | 8/2006 | Blum et al. | 340/691.6 |
| 2007/0175132 | A1 * | 8/2007 | Spransy et al. | 52/263 |
| 2007/0258255 | A1 * | 11/2007 | Kessler et al. | 362/487 |
| 2009/0282766 | A1 * | 11/2009 | Roen | 52/506.08 |
| 2010/0103695 | A1 * | 4/2010 | Opitz et al. | 362/554 |

* cited by examiner 413A
415A
411A
41A
412A
40A
42A
414A 40A
41A
42A
413A
413A 40A
41A
42A
415A
414A
413A
412A 40A
42A
412A
41A
411A
413A

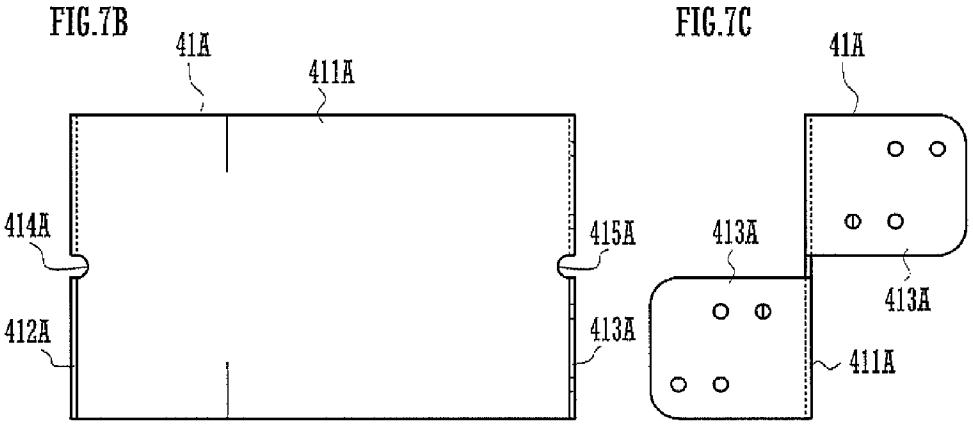
FIG.7A
FIG.7B
FIG.7C
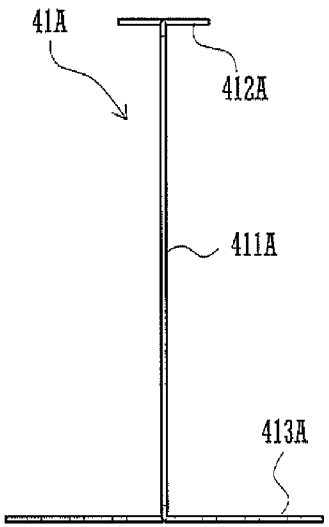
FIG.7D

FLOOR TYPE MULTI-DISPLAY APPARATUS AND FLOOR STRUCTURE FOR INSTALLATION OF A FLOOR TYPE MULTI-DISPLAY APPARATUS

CROSS REFERENCE

This Nonprovisional application claims priority under 35 U.S.C. §119(a) on Patent Application No. 2010-185953 filed in Japan on Aug. 23, 2010, the entire contents of which are hereby incorporated by reference.

BACKGROUND OF THE INVENTION

The present invention relates to a floor type multi-display apparatus having a multi-display comprising a plurality of displays arranged in a matrix form, as well as a floor structure for installation of such a floor type multi-display apparatus.

In recent years, a multi-display comprising a plurality of displays arranged in a matrix form is known. In such a multi-display, the plurality of displays form a single display screen. For this reason, use of narrower bezel displays will provide a more easily viewable image because lowering in the continuity between images provided by adjacent ones of the displays can be suppressed.

Such a multi-display is sometimes incorporated in a floor type multi-display apparatus to be installed on a floor, as described in Japanese National Publication of International Application No. 2005-528658. Such a floor type multi-display apparatus is provided with a transparent panel disposed above the multi-display in order to protect the multi-display from damage due to pressure and shock.

Support members which support the transparent panel are supported on a support surface extending below the multi-display. Since the support members are disposed to extend through a range from below the multi-display to above the multi-display, some of the support members may pass between adjacent ones of the displays.

The conventional floor type multi-display apparatus described in Japanese National Publication of International Application No. 2005-528658 is designed to disperse pressure and shock exerted on the transparent panel by the plurality of support members sharing the pressure and shock. For this purpose, each of the support members is required to have a high rigidity and comprises a material of columnar shape or the like. However, when a columnar or prismatic material is used as a support member as in the conventional art, adjacent ones of the displays define a widened gap therebetween and, hence, the continuity between images provided by the adjacent displays is lowered, which results in a multi-display apparatus providing a less easily viewable image.

A feature of the present invention is to provide a floor type multi-display apparatus which is capable of providing an easily viewable image, as well as a floor structure for installation of such a floor type multi-display apparatus.

SUMMARY OF THE INVENTION

A floor type multi-display apparatus according to the present invention includes a multi-display, one or more transparent panels, and a plurality of support members. The multi-display comprises a plurality of displays arranged in a matrix form along a floor. The transparent panels are spaced upwardly apart from the multi-display in such a manner as to cover the multi-display entirely. The support members includes a plurality of first support members disposed between adjacent ones of the plurality of displays in a scattered fashion, and one or more second support members disposed around the multi-display. The plurality of support members have respective plate portions positioned along and closely to edges of the displays, respective support portions formed at upper ends of the respective plate portions to support the transparent panels, and respective base portions formed at lower ends of the respective plate portions and supported on a support surface extending below the multi-display. The support portion and the base portion of each of the first support members project toward two displays located closely thereto from the plate portion of the first support member. The support portion and the base portion of each of the second support members project toward only one display located closely thereto from the plate portion of the second support member.

In this arrangement, the first support members have respective plate portions. Since the plate portions are positioned between adjacent ones of the displays, the adjacent ones of the displays define a narrowed gap therebetween, so that lowering in the continuity between images provided by the adjacent ones of the displays is suppressed. The first support members are not disposed all over the gap region between adjacent ones of the displays, but are scattered like dots. For this reason, the displays have a reduced blind spot area which cannot be viewed due to hindrance of the first support members particularly when the displays are viewed askew. Further, since the first support members supporting the transparent panels are disposed in a scattered fashion, the transparent panels can be inhibited from deflection. For this reason, the transparent panels can have a reduced thickness.

The support portion and the base portion of each of the first support members disposed between adjacent ones of the displays project toward two displays located closely thereto from the plate portion of the first support member. This feature makes the support portion and the base portion have an improved pressure resistance as compared to a case where the support portion and the base portion project toward only one side while the lengths thereof in the projecting direction each remain the same. Further, since the support portion of each first support member projects toward the two displays on opposite sides, the contour of each display and that of the corresponding transparent panel can be positioned coincidentally with each other in directions along the floor when the transparent panels are provided in one-to-one relationships with the plurality of displays. Therefore, an image provided by the multi-display is prevented from becoming hard to view because of the contour of each transparent panel overlapping the image. The support portion and the base portion of each of the second support members disposed around the multi-display project toward only one display located closely thereto from the plate portion of the second support member and do not project outwardly of the multi-display. This feature can make all the transparent panels have a unified size when the plurality of transparent panels are provided. This leads to an improved manufacturing efficiency and a lowered cost. Thus, the present invention makes it possible to provide an easily viewable image.

A floor structure for installation of a floor type multi-display apparatus according to the present invention includes the floor type multi-display apparatus as described above, and a duct configured to enable a gap space between the multi-display and the transparent panels to communicate with outside. The multi-display is accommodated within a recess formed in the floor. The transparent panels are disposed in such a manner that their respective top surfaces are positioned coplanar with the floor.

With this structure, heat released from the displays into the gap space between the multi-display and the transparent panels is exhausted to the outside through the duct. This arrangement can suppress damage to the floor type multi-display apparatus by heat.

BRIEF DESCRIPTION OF THE DRAWINGS

FIG. 7A is a plan view of a support plate forming part of the first short side support member, FIG. 7B is a right-hand side elevational view of the support plate, FIG. 7C is a bottom view of the support plate, and FIG. 7D is a front elevational view of the support plate;

DETAILED DESCRIPTION OF THE INVENTION

Hereinafter, an embodiment of the present invention will be described with reference to the attached drawings.

Figure 1:
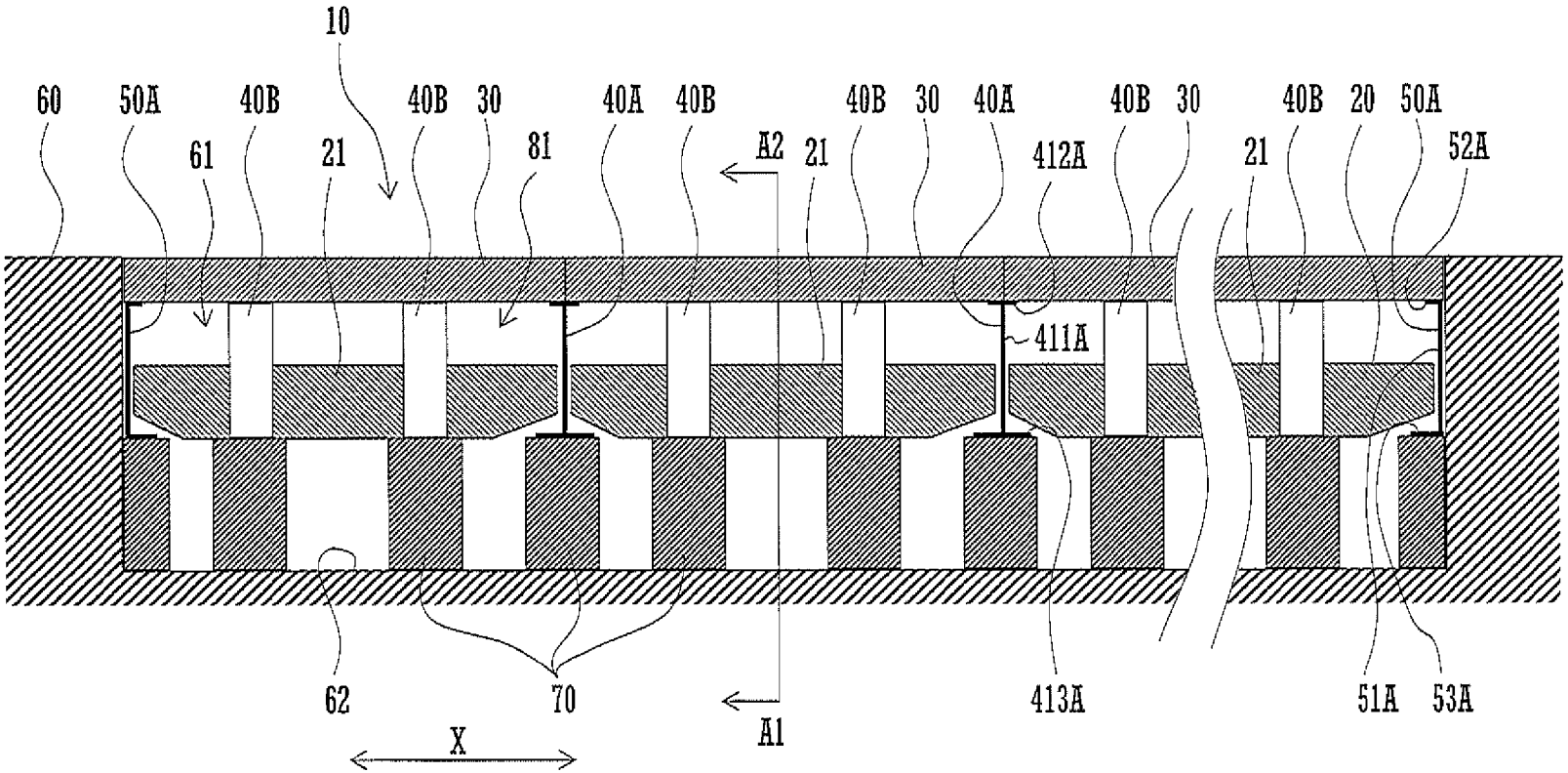
FIG. 1 is a sectional front elevational view illustrating a floor type multi-display apparatus according to an embodiment of the present invention.
Figure 2:
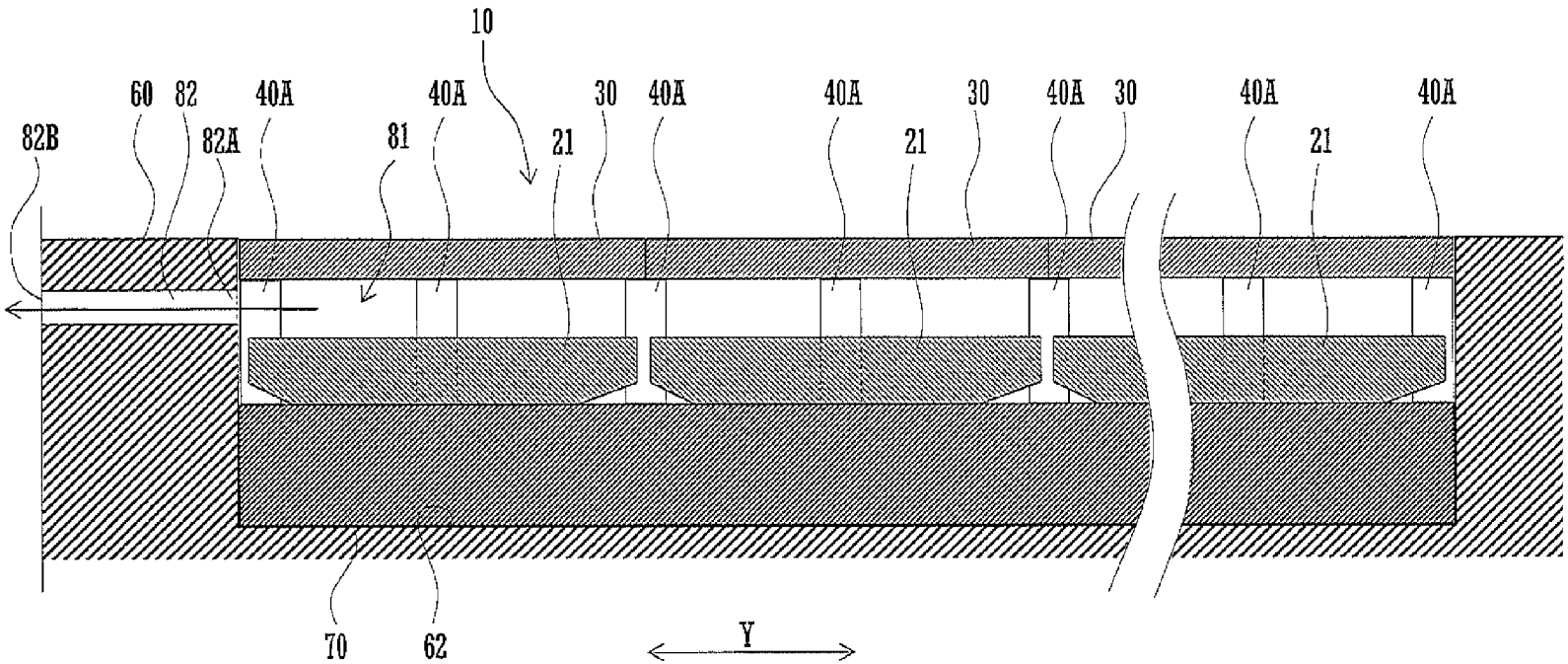
FIG. 2 is a sectional view, taken on line A1-A2 of FIG. 1, illustrating a floor structure for installation of a floor type multi-display apparatus.
Figure 3:
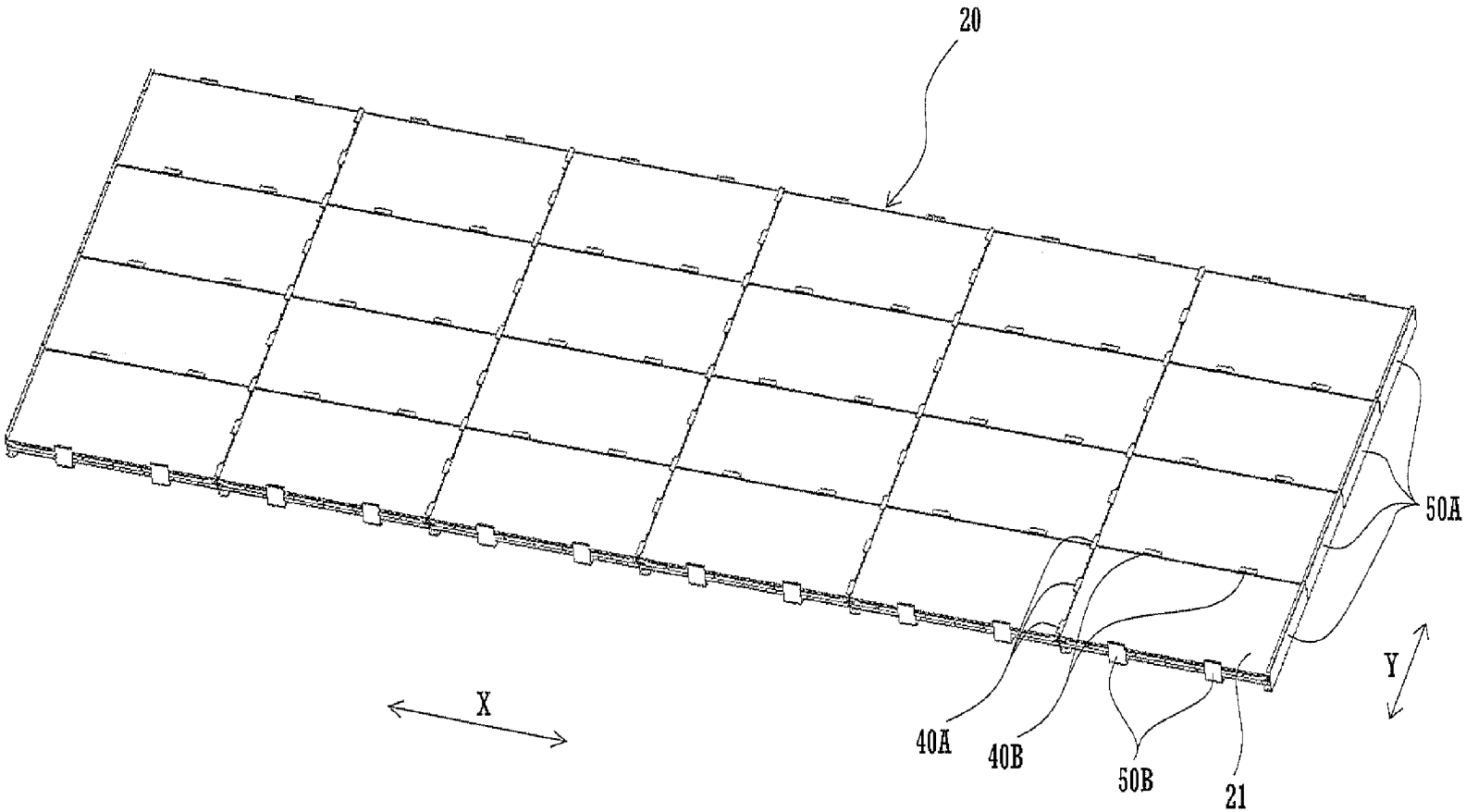
FIG. 3 is a perspective view illustrating a multi-display and support members incorporated in the floor type multi-display apparatus.

Referring to FIGS. 1 to 3, a floor type multi-display apparatus 10 includes a multi-display 20, a plurality of transparent panels 30, and a plurality of support members including a plurality of first support members 40 and a plurality of second support members 50. In each of FIGS. 1 and 2, part of the sectional view is omitted.

The multi-display 20 comprises a plurality of displays 21 arranged in a matrix form along a floor 60. The plurality of displays 21 form a single display screen. In an exemplary arrangement as shown in FIG. 3, the multi-display 20 comprises 24 displays 21, specifically, 4 rows 6 columns of displays 21. The plurality of displays 21 each have a rectangular outward form in plan view and have the same size. Preferably, each of the displays 21 has a narrow bezel.

The floor 60 is formed with a recess 61. In an exemplary arrangement, a bottom surface 62 of the recess 61 and the floor 60 are formed to extend horizontally. The multi-display 20 is accommodated within the recess 61. A plurality of support struts 70 stand upright on the bottom surface 62 of the recess 61. Each of the support struts 70 extends from a sidewall of the recess 61 at one side to a sidewall of the recess 61 at the other side in the Y-direction parallel with the short sides of the displays 21. The plurality of support struts 70 are spaced apart from each other in the X-direction parallel with the long sides of the displays 21. The displays 21 are supported by the plurality of support struts 70 in such manner that their top surfaces extend along the floor 60.

The transparent panels 30 each comprise an acrylic sheet. The plurality of transparent panels 30 are disposed above the multi-display 20 to cover the entire multi-display 20 and are spaced upwardly apart from the multi-display 30 to define a gap 81 therebetween. The plurality of transparent panels 30 are disposed in such a manner that their top surfaces are positioned coplanar with the floor 60. In an exemplary arrangement, the plurality of transparent panels 30 are each positioned coincidentally with a respective one of the plurality of displays 21. That is, the number of transparent panels 30 provided is equal to the number of displays 21 so that one transparent panel 30 covers one display 21 entirely.

The plurality of transparent panels 30 are supported by the plurality of first support members 40 and the plurality of second support members 50. Each of the first support members 40 and each of the second support members 50 are formed of stainless steel.

The plurality of first support members 40 are disposed between adjacent ones of the plurality of displays 21 in a scattered fashion. The plurality of second support members 50 are disposed around the multi-display 20.

In the following description, those first support members 40 which are disposed between short sides of adjacent displays 21 are referred to as "first short side support members 40A", as the case may be. Those first support members 40 which are disposed between long sides of adjacent displays 21 are referred to as "first long side support members 40B", as the case may be. Those second support members 50 which are disposed along short sides of the multi-display 20 are referred to as "second short side support members 50A", as the case may be. Those second support members 50 which are disposed along long sides of the multi-display 20 are referred to as "second long side support members 50B", as the case may be.

Figure 4:
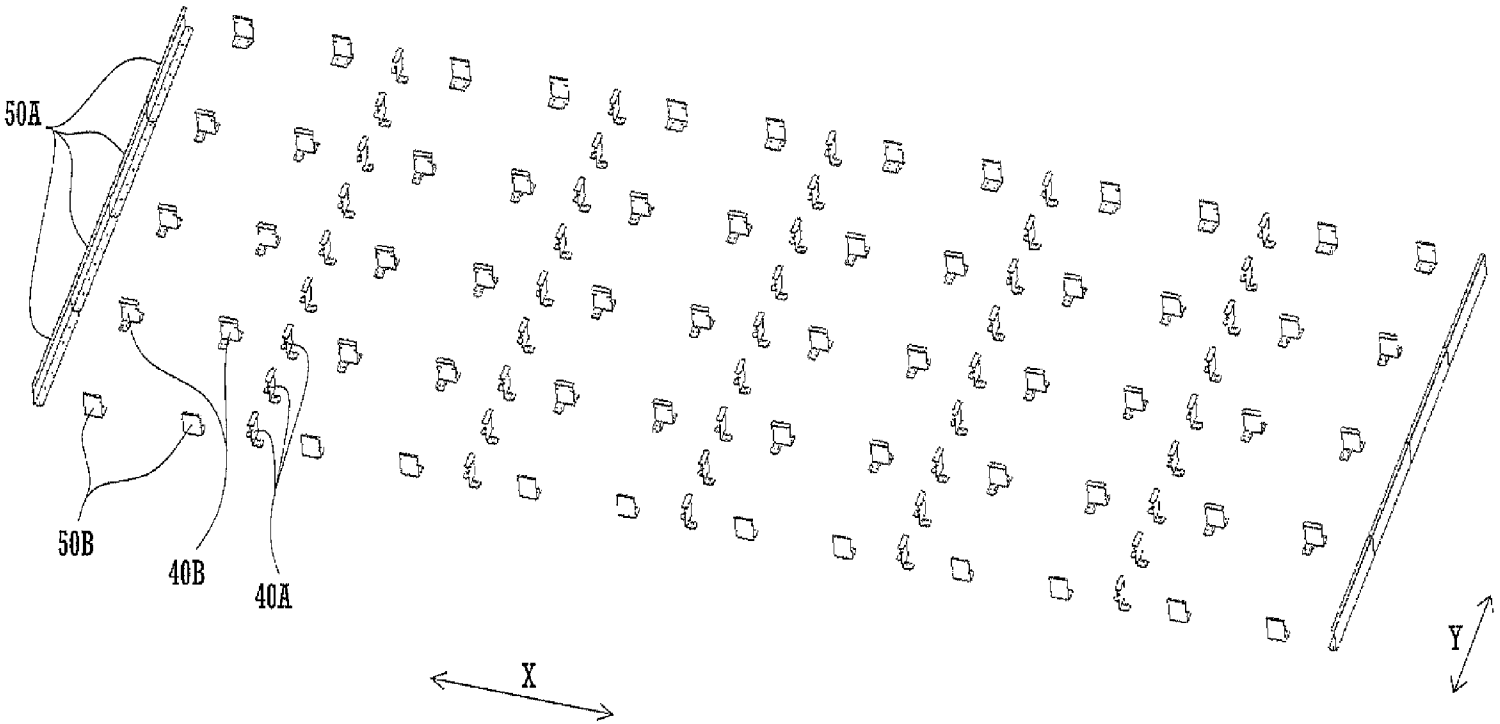
FIG. 4 is a perspective view illustrating an arrangement of a plurality of support members.
Figure 5:
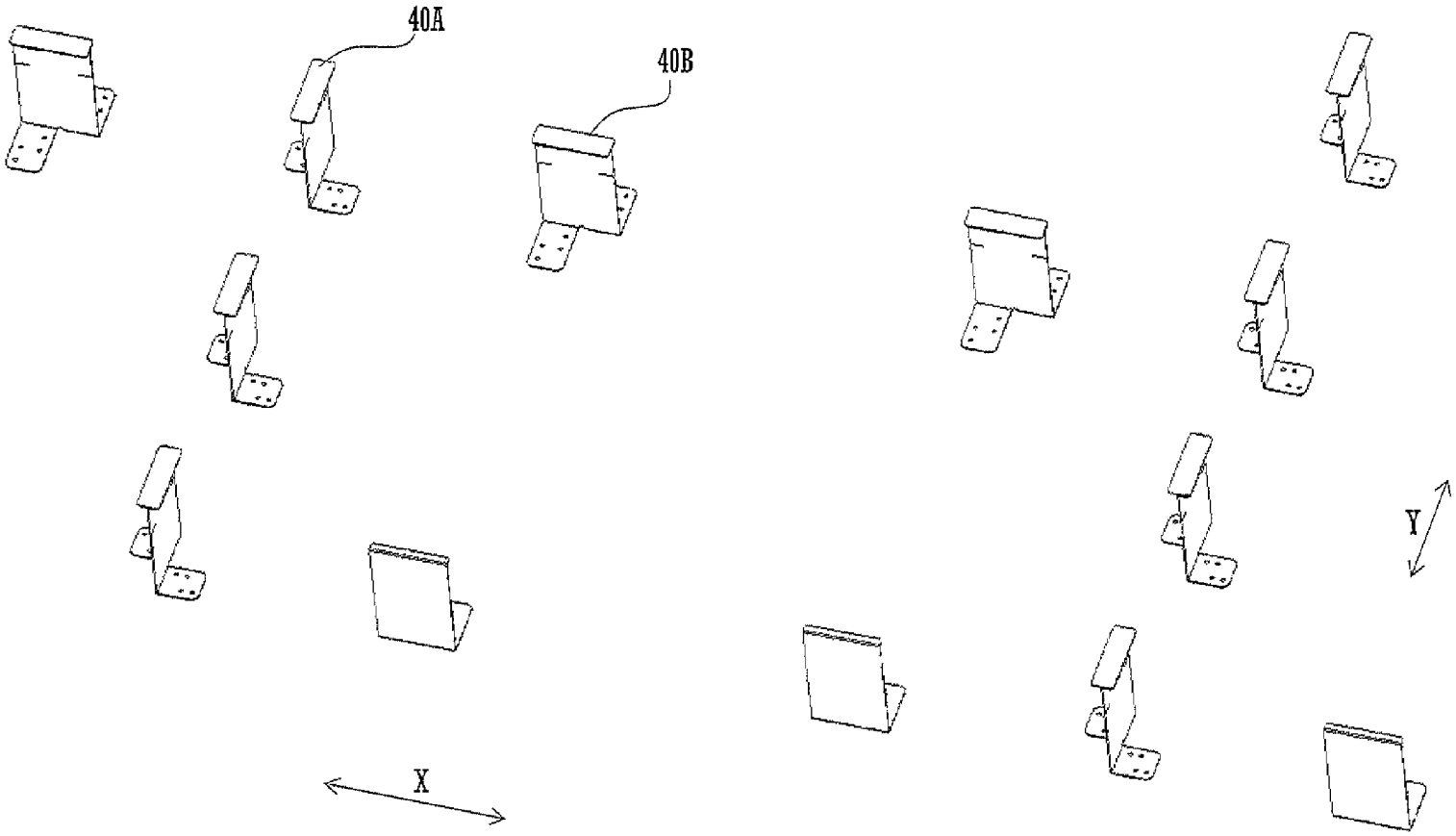
FIG. 5 is an enlarged view illustrating an arrangement of some of the support members.
Figures 6A, 6B, 6C, 6D:
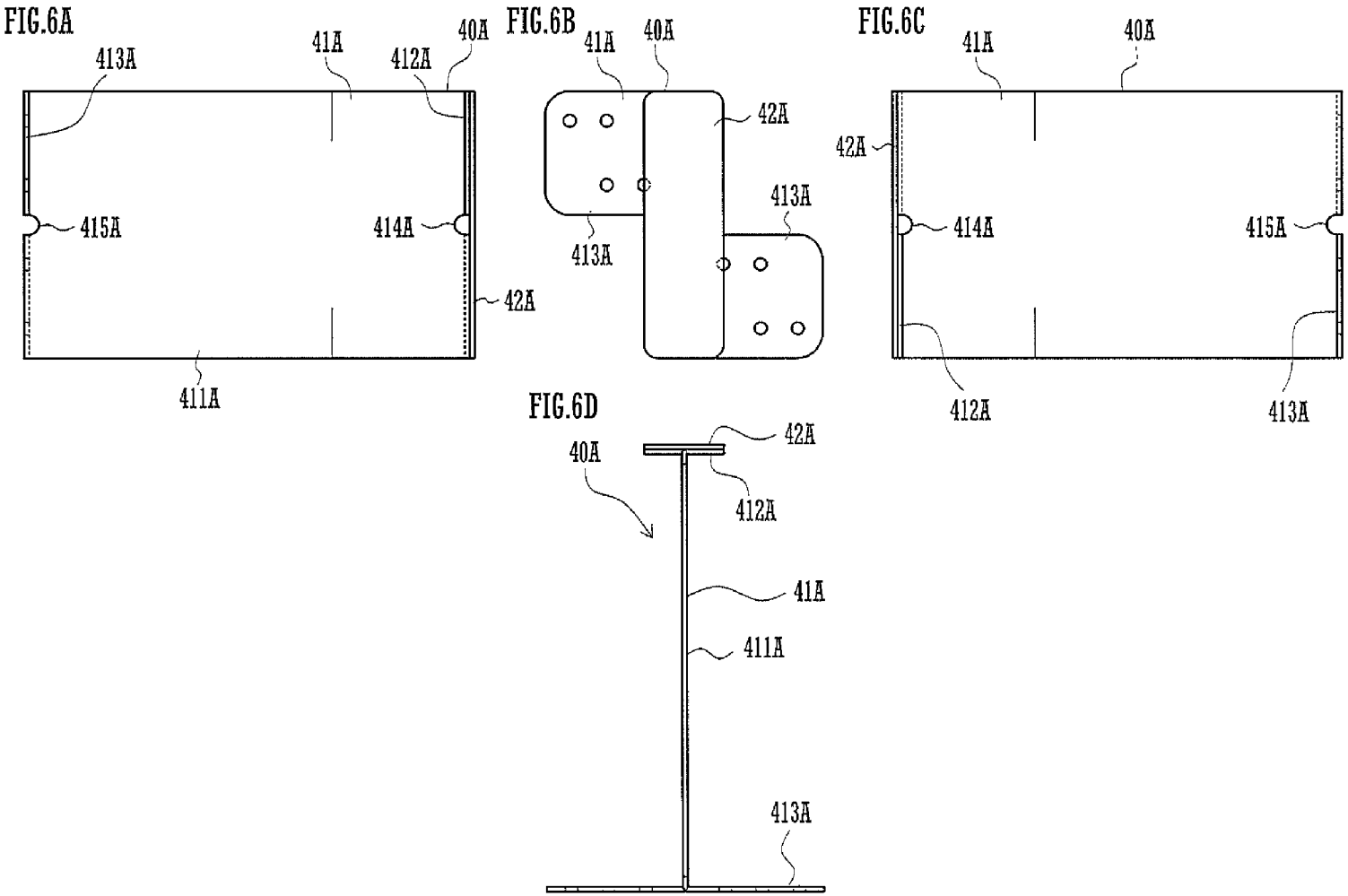
FIG. 6A is a left-hand side elevational view of a first short side support member.
FIG. 6B is a plan view of the first short side support member.
FIG. 6C is a right-hand side elevational view of the first short side support member.
FIG. 6D is a front elevational view of the first short side support member.

As shown in FIGS. 3 to 5, the first short side support members 40A are arranged in the Y-direction parallel with the short sides of the displays 21. The first long side support members 40A are arranged in the X-direction parallel with the long sides of the displays 21.

The first short side support members 40A are located in such a manner that: a central portion of each display 21 in the Y-direction is supported by one first short side support member 40A; each of the opposite ends of the multi-display 20 in the Y-direction is supported by one first short side support member 40A; and adjacent ends of two adjacent displays 21 in the Y-direction are supported by one first short side support member 40A. The first long side support members 40B are located with a predetermined spacing therebetween in such a manner that two first long side support members 40B support one long side of each display 21.

Each of the second short side support members 50A is provided to support the short side of each of the displays 21 located along the short sides of the multi-display 20. Each of the second short side support members 50A has the same length as the short side of each display 21 in the Y-direction. As a result, the second short side support members 50A cover the entire length of the short sides of the multi-display 20. The second long side support members 50B are located similarly to the first long side support members 40B.

As shown in FIG. 2, the floor 60 is provided therein with a duct 82. The duct 82 has one end 82A which is open through a sidewall of the recess 61 to communicate with the gap 81 defined between the multi-display 20 and the transparent panels 30. The duct 82 has an opposite end 82B which is open to the outside of the floor type multi-display apparatus 10. Thus, heat released from the displays 21 into the space forming the gap 81 is exhausted to the outside through the duct 82. Therefore, damage to the floor type multi-display apparatus 10 by heat can be suppressed. The duct 82 may be provided therein with a fan for exhausting air from the gap 81 to the outside.

Referring to FIGS. 6A to 6D, 7A to 7D, 8A and 8B, the first short side support members 40A each comprise a support plate 41A and a reinforcement plate 42A.

As shown in FIGS. 7A to 7D, the support plate 41A comprises a plate portion 411A, a support portion 412A, and a base portion 413A and is formed by bending one metal sheet by metal press working. In an exemplary embodiment, the support plate 41A and the reinforcement plate 42A each have a thickness of 2 mm.

The plate portion 411A is shaped substantially rectangular and stands vertically. The plate portion 411A is formed with a semicircular notch 414A at a widthwise central portion of an upper edge thereof. Similarly, a semicircular notch 415A is formed at a widthwise central portion of a lower edge of the plate portion 411A. By providing the plate portion 411A with the notches 414A and 415A, the occurrence of crack during metal press working can be suppressed.

The support portion 412A is formed at the upper end of the plate portion 411A. The support portion 412A is formed by bending opposite portions of the upper edge of the plate portion 411A on widthwise opposite sides of the plate portion 411A across the notch 414A in such a manner that these portions project in opposite directions. The plate portion 411A and the support portion 412A are positioned perpendicular to each other.

The base portion 413A is formed at the lower end of the plate portion 411A. Like the support portion 412A, the base portion 413A is formed by bending opposite portions of the lower edge of the plate portion 411A on widthwise opposite sides of the plate portion 411A across the notch 415A in such a manner that these portions project in opposite directions. The plate portion 411A and the base portion 413A are positioned perpendicular to each other. The support portion 412A and the base portion 413A are parallel with each other. In an exemplary embodiment, the support portion 412A and the base portion 413A are positioned in such manner that the base portion 413A is located just below the support portion 412A, as shown in FIG. 7A.

Figure 8A:
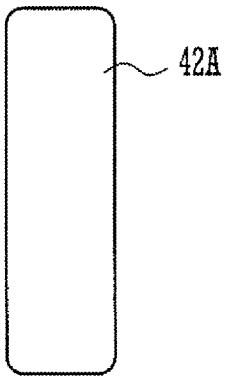
FIG. 8A is a plan view of a reinforcement plate forming part of the first short side support member.
Figure 8B:
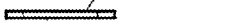
FIG. 8B is a front elevational view of the reinforcement plate.

As shown in FIGS. 8A and 8B, the reinforcement plate 42A is shaped into a plate. The reinforcement plate 42A is welded to the support portion 412A, as shown in FIGS. 6A to 6D.

Figure 9:
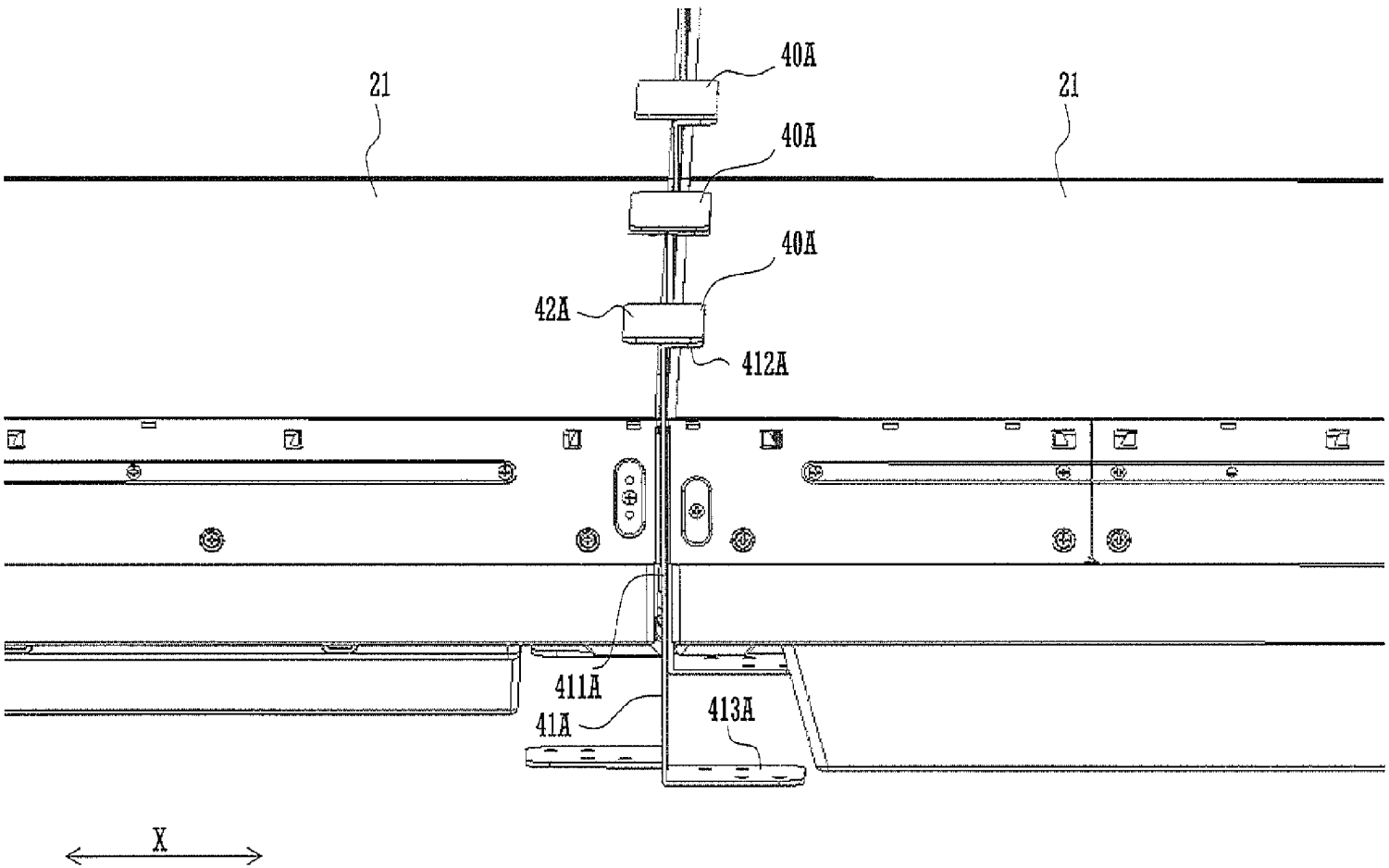
FIG. 9 is a perspective view illustrating first short side support members disposed between adjacent displays.
Figure 10A:
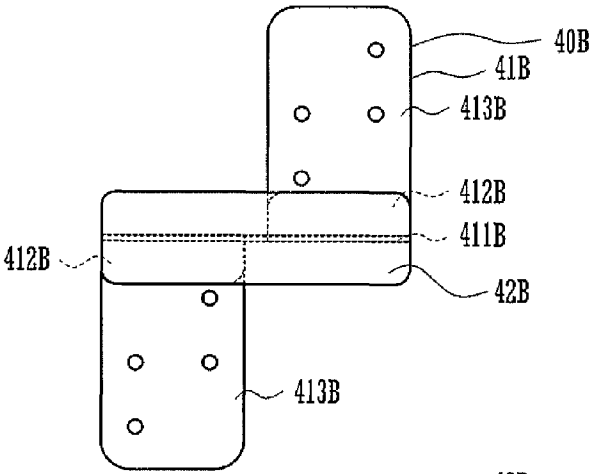
FIG. 10A is a plan view of a first long side support member.
Figure 10B:
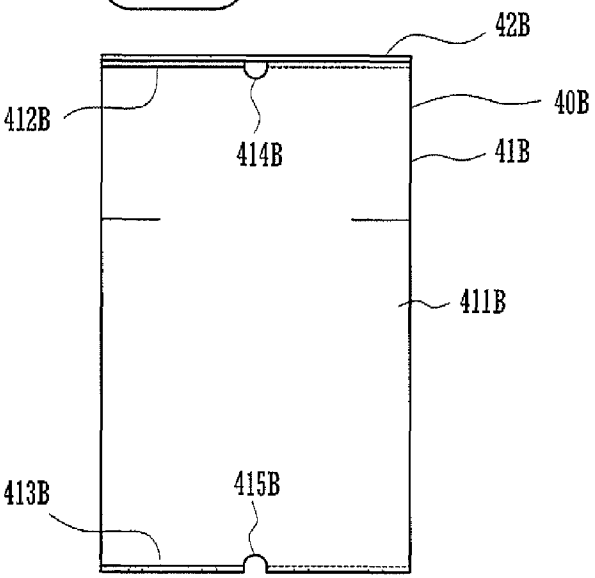
FIG. 10B is a front elevational view of the first long side support member.
Figure 11B:
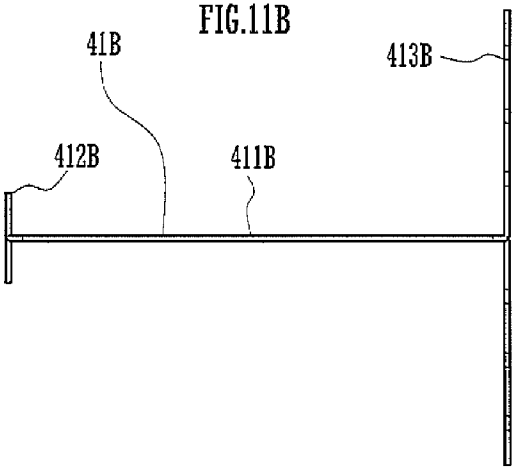
FIG. 11B is a right-hand side elevational view of the support plate.
Figure 11A:
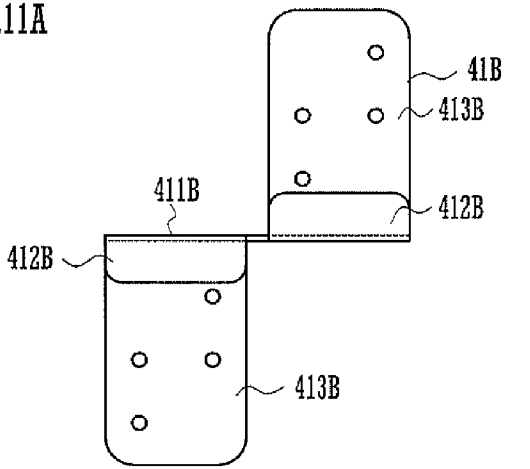
FIG. 11A is a plan view of a support plate forming part of the first long side support member.
Figure 11C:
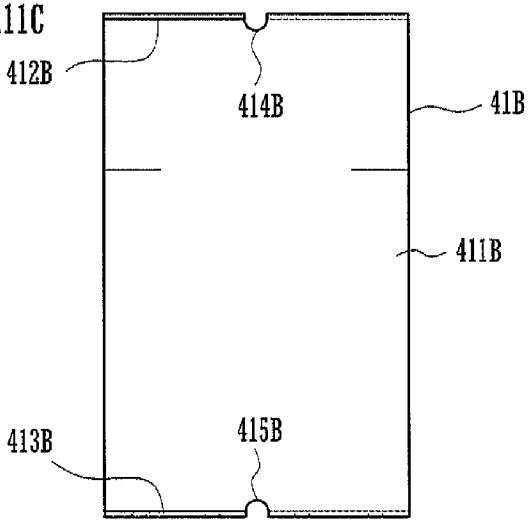
FIG. 11C is a front elevational view of the support plate.
Figure 12B:
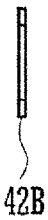
FIG. 12B is a right-hand side elevational view of the reinforcement plate.
Figure 12A:
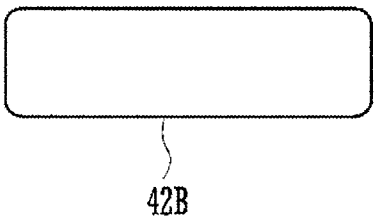
FIG. 12A is a plan view of a reinforcement plate forming part of the first long side support member.

Referring to FIG. 9, the plate portions 411A of the respective first short side support members 40A are positioned along and closely to the side edges of the respective displays 21. The support portions 40A of the respective first short side support members 40A, together with the reinforcement plates 42A, support the transparent panels 30 thereon. The base portion 413A of each first short side support member 40A is fixed to the upper end of the associated support strut 70 and hence is supported on the bottom surface (i.e., support surface) 62 via the support strut 70. Note that the transparent panels 30 and the support struts 70 are not shown in FIG. 9.

The support portion 412A and base portion 413A of each first short side support member 40A project toward two displays 21 located closely thereto from the plate portion 411A of the first short side support member 40A.

Referring to FIGS. 10A, 10B, 11A to 11C, 12A and 12B, the first long side support members 40B each comprise a support plate 41B and a reinforcement plate 42B. The support plate 41B comprises a plate portion 411B, a support portion 412B, and a base portion 413B and is formed by bending one metal sheet by is metal press working. Like the plate portion 411A, the plate portion 411B has notches 414B and 415B. Each of the first long side support members 40B is substantially similar to each of the first short side support members 40A.

Figure 13:
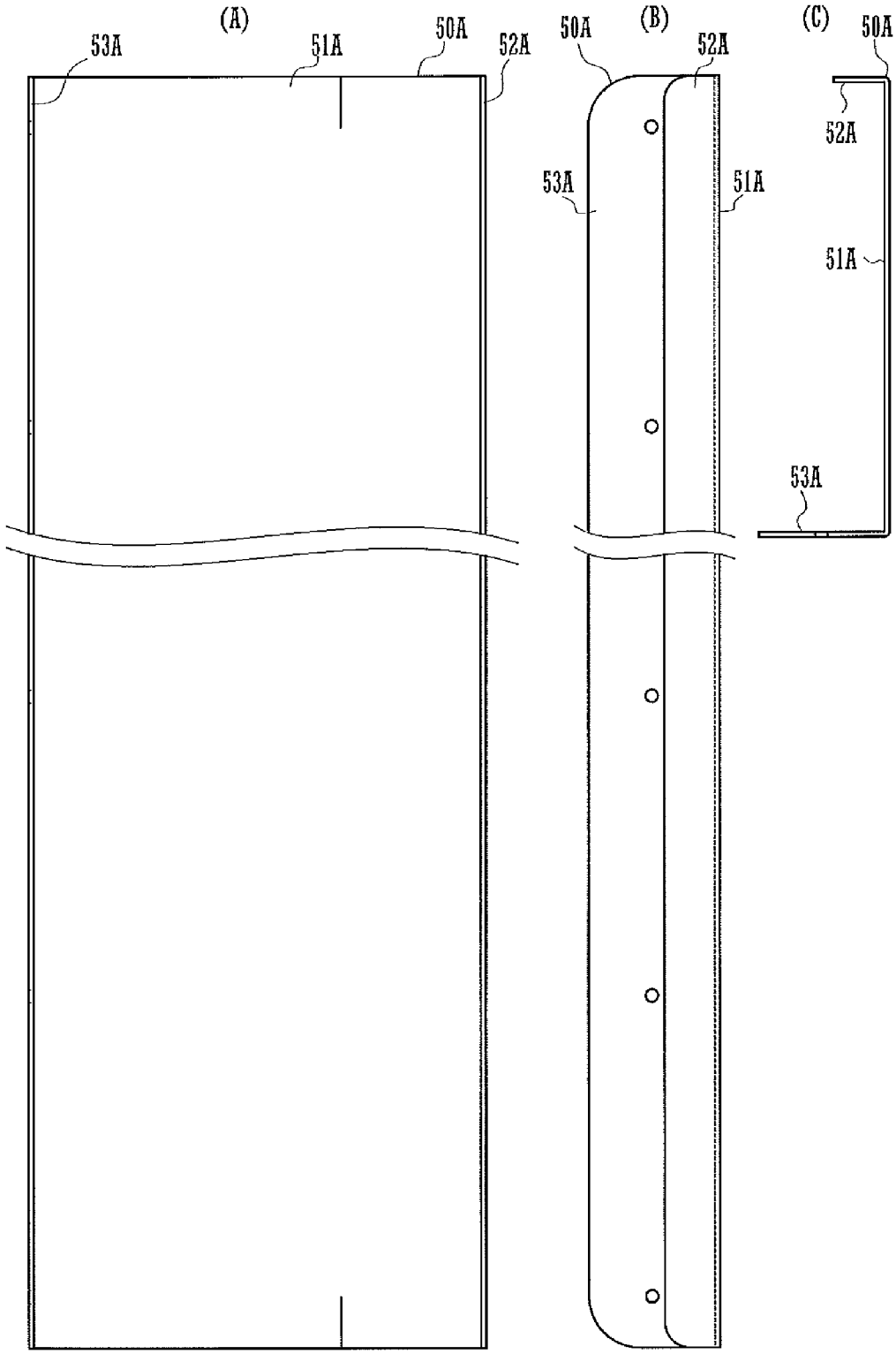
FIG. 13A is a left-hand side elevational view of a second short side support member.
FIG. 13B is a plan view of the second short side support member.
FIG. 13C is a front elevational view of the second short side support member.

Referring to FIGS. 13A to 13C, the second short side support members 50A each comprise a plate portion 51A, a support portion 52A, and a base portion 53A and are each formed by bending one metal sheet by metal press working. In an exemplary embodiment, the second short side support members 50A each have a thickness of 2 mm.

The plate portion 51A is shaped rectangular and stands vertically. The support portion 52A is formed at the upper end of the plate portion 51A. The support portion 52A is formed by bending the upper edge of the plate portion 51A in such a manner that the resulting bent portion projects toward one side from the plate portion 51A. The support portion 52A and the plate portion 51A are positioned perpendicular to each other.

The base portion 53A is formed at the lower end of the plate portion 51A. The base portion 53A is formed by bending the lower edge of the plate portion 411A in such a manner that the resulting bent portion projects toward one side from the plate portion 51A. The base portion 53A and the plate portion 51A are positioned perpendicular to each other. The support portion 52*a* and the base portion 53A extend parallel with each other and project in the same direction from the plate portion 51A.

Each of the second short side support members 50A is disposed in such a manner that its support portion 52A and base portion 53A project toward only one display 21 located closely thereto from the plate portion 51A of the second short side support member 50A.

Figure 14A:
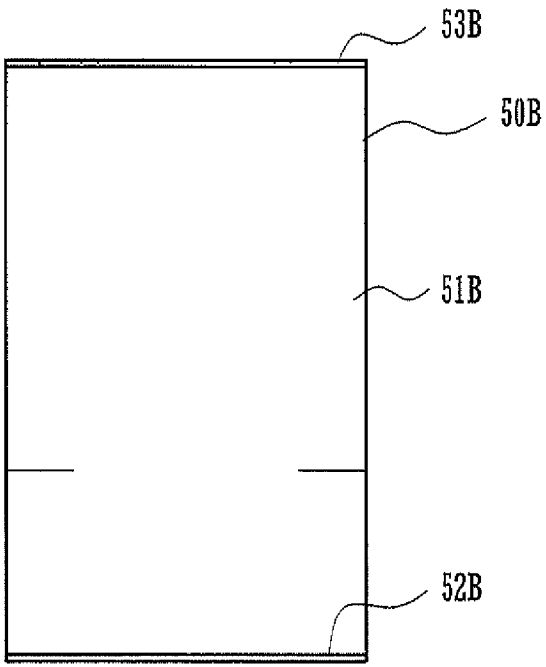
FIG. 14A is a rear elevational view of a second long side support member.
Figure 14B:
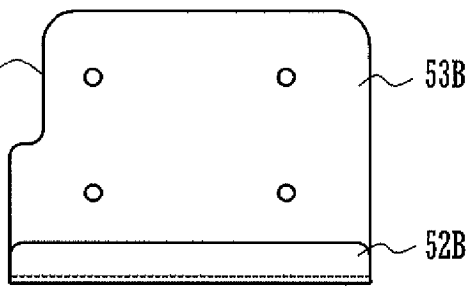
FIG. 14B is a plan view of the second long side support member.
Figure 14C:
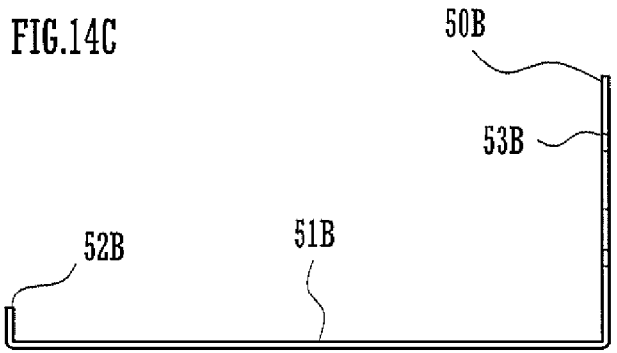
FIG. 14C is a right-hand side elevational view of the second short side support member.

Referring to FIGS. 14A to 14C, the second long side support members 50B each comprise a plate portion 51B, a support portion 52B, and a base portion 53B and are each formed by bending one metal sheet by metal press working. The second long side support members 50B are substantially similar to the second short side support members 50A in that the support portion 52B and base portion 53B of each second long side support member 50B are bent to project toward one side from the plate portion 51B of the second long side support member 50B.

Each of the second long side support members 50B is disposed in such a manner that its support portion 52B and base portion 53B project toward only one display 21 located closely thereto from the plate portion 51B of the second long side support member 50B.

According to the floor type multi-display apparatus 10 thus constructed, the plate portions 411A and 411B are positioned between adjacent ones of the displays 21. Therefore, the adjacent displays 21 define a narrowed gap therebetween, thereby suppressing lowering in the continuity between images provided by the adjacent displays 21. Thus, the floor type multi-display apparatus 10 can provide an easily viewable image. The first short side support members 40A and the first long side support members 40B are not disposed all over the gap region between adjacent ones of the displays 21, but are scattered like dots therein. For this reason, the displays 21 have a reduced blind spot area which cannot be viewed due to hindrance of the first short side support members 40A and first long side support members 40B particularly when the displays 21 are viewed askew. Further, since the plurality of first short side support members 40A and the plurality of first long side support members 40B, which support the transparent panels 30, are disposed in a scattered fashion, the transparent panels 30 can be inhibited from deflection. For this reason, the transparent panels 30 can have a reduced thickness.

The support portion 412A and base portion 413A of each first short side support member 40A disposed between adjacent ones of the displays 21 project toward two displays 21 located closely thereto from the plate portion 411A of the first short side support member 40A, while the support portion 412B and base portion 413B of each first long side support member 40B disposed between adjacent ones of the displays 21 project toward two displays 21 located closely thereto from the plate portion 411B of the first long side support member 40B. With this arrangement, the support portion 412A has a reduced amount of projection and hence has an improved pressure resistance as compared to a case where the support portion 412A projects toward only one side while the length thereof in the projecting direction remains the same. Likewise, the support portion 412B has an improved pressure resistance as compared to a case where the support portion 412B projects toward only one side while the length thereof in the projecting direction remains the same. The base portion 413A has an improved pressure resistance as compared to a case where the base portion 413A projects toward only one side while the length thereof in the projecting direction remains the same. Likewise, the base portion 413B has an improved pressure resistance as compared to a case where the base portion 413B projects toward only one side while the length thereof in the projecting direction remains the same.

Further, the support portion 412A of each first short side support member 40A projects toward two displays located closely thereto and, likewise, the support portion 412B of each first long side support member 40B projects toward two displays located closely thereto. For this reason, the contour of each display 21 and that of the corresponding transparent panel 30 can be positioned substantially coincidentally with each other in directions along the floor 60 when the transparent panels 30 are provided in one-to-one relationships with the plurality of displays 21. Therefore, an image provided by the multi-display 20 is prevented from becoming hard to view because of the contour of each transparent panel 30 overlapping the image.

As described above, the second short side support members 50A and the second long side support members 50B are disposed around the multi-display 20. The support portion 52A and base portion 53A of each second short side support member 50A project toward only one display 21 located closely thereto from the plate portion 51A of the second short side support member 50A and do not project away from the multi-display 20, while the support portion 52B and base portion 53B of each second long side support member 50B project toward only one display 21 located closely thereto from the plate portion 51B of the second long side support member 50B and do not project away from the multi-display 20. This feature can make all the transparent panels 30 have a unified size even when the second short side support members 50A and the second long side support members 50B are disposed so as not project outwardly of the transparent panels 30 in the above-described arrangement provided with the plurality of transparent panels 30. This leads to an improved manufacturing efficiency and a lowered cost.

The first short side support members 40A, as well as the first long side support members 40B, second short side support members 50A and second long side support members 50B, are each formed by bending one metal sheet, as described above. The plate portions 411A of the first short side support members 40A and the plate portions 411B of the first long side support members 40B are positioned between adjacent ones of the displays 21. Therefore, the gap between adjacent ones of the displays 21 can have a width as small as the thickness of one metal sheet. This feature can suppress lowering in the continuity between images provided by adjacent displays 21. The plate portions 51A of the second short side support members 50A and the plate portions 51B of the second long side support members 50B are located around the multi-display 20. Therefore, the gap around the multi-display 20 can have a width as small as the thickness of one metal sheet. This feature can suppress penetration of dust into the apparatus.

Further, since the multi-display 20 is entirely covered with the plurality of transparent panels 30, the transparent panels 30 of a certain size can be used in multi-displays of different sizes. Thus, the transparent panels 30 have improved versatility.

The plurality of transparent panels 30 are positioned coincidentally with the respective displays 21. Therefore, each transparent panel 30 can have a reduced size as compared to a case where one transparent panel 30 covers a plurality of displays 21. For this reason, it becomes easy to transport and control the transparent panels 30. Further, the plurality of transparent panels 30 can be formed to have the same size, which leads to a lower cost.

The number of transparent panels 30 to be used need not necessarily be equal to the number of displays 21. The plurality of displays 21 may be wholly covered with a single transparent panel 30. The number of transparent panels 30 is not limited to a plural number. A single transparent panel may cover the entire multi-display 20.

Each of the first short side support members 40A need not necessarily be provided with the reinforcement plate 42A, but may be formed of the support plate 41A. Likewise, each of the first long side support members 40B need not necessarily be provided with the reinforcement plate 42B, but may be formed of the support plate 41B.

The second short side support members 50A may be disposed along the short sides of the multi-display 20 in a scattered fashion. That is, it is possible that the first short side support members 40A, first long side support members 40B, second short side support members 50A and second long side support members 50B are all disposed around the peripheries of the respective displays 21 in a scattered fashion.

The number of second support members is not limited to a plural number, but may be one. For example, use may be made of a single second support member extending along the entire periphery of the multi-display 20.

The floor type multi-display apparatus 10 is of the type to be installed on the floor 60 and, hence, the multi-display 20 is positioned along the floor 60. However, the multi-display 20 need not necessarily be accommodated within the recess 61 formed in the floor 60. Even when the multi-display 20 is placed above and parallel with the floor 60, the use of the plurality of support members described above makes it possible to bring about advantages including providing an easily viewable image by suppressing lowering in the continuity between images provided by adjacent displays 21.

The floor 60 need not necessarily be formed to extend horizontally. Even when the floor type multi-display apparatus 10 is installed on a floor that is slightly inclined relative to a horizontal plane (for example, at an angle equal to and less than 5 degrees), the floor type multi-display apparatus 10 can bring about advantages including providing an easily viewable image by suppressing lowering in the continuity between images provided by adjacent displays 21.

The foregoing embodiments should be construed to be illustrative and not limitative of the present invention in all the points. The scope of the present invention is defined by the following claims, not by the foregoing embodiments. Further, the scope of the present invention is intended to include the scopes of the claims and all possible changes and modifications within the senses and scopes of equivalents.

What is claimed is:

1. A floor type multi-display apparatus comprising:

a multi-display including a plurality of displays arranged in a matrix form along a floor;

one or more transparent panels spaced upwardly apart from the multi-display in such a manner as to cover the multi-display entirely; and a plurality of support members including a plurality of first support members disposed in such a manner as to be between adjacent ones of the plurality of displays, and one or more second support members disposed around the multi-display, wherein:

the plurality of support members have respective plate portions positioned along and closely to edges of the displays, respective support portions formed at upper ends of the respective plate portions to support the transparent panels, and respective base portions formed at lower ends of the respective plate portions and supported on a support surface extending below the multi-display;

the support portion and the base portion of each of the first support members project from the plate portion of the first support member toward two displays among the plurality of displays arranged in the matrix form, the two displays being located close to the first support members; and the support portion and the base portion of each of the second support members project from the plate portion of the second support member toward only one display among the plurality of displays arranged in the matrix form, the one display being located close to the second support members.

2. The floor type multi-display apparatus according to claim 1, wherein each of the plurality of support members is formed by bending one metal sheet.

3. The floor type multi-display apparatus according to claim 1, wherein the transparent panels are arranged corresponding to the plurality of displays.

4. A floor structure for installation of a floor type multi-display apparatus, comprising the floor type multi-display apparatus and a duct, wherein:

the floor type multi-display apparatus comprises:

a multi-display including a plurality of displays arranged in a matrix form along a floor;

one or more transparent panels spaced upwardly apart from the multi-display in such a manner as to cover the multi-display entirely; and a plurality of support members including a plurality of first support members disposed in such a manner as to be between adjacent ones of the plurality of displays, and one or more second support members disposed around the multi-display;

the plurality of support members have respective plate portions positioned along and closely to edges of the displays, respective support portions formed at upper ends of the respective plate portions to support the transparent panels, and respective base portions formed at lower ends of the respective plate portions and supported on a support surface extending below the multi-display;

the support portion and the base portion of each of the first support members project from the plate portion of the first support member toward two displays among the plurality of displays arranged in the matrix form, the two displays being located close to the first support members;

the support portion and the base portion of each of the second support members project from the plate portion of the second support member toward only one display among the plurality of displays arranged in the matrix form, the one display being located close to the second support members;

the duct is configured to enable a gap space between the multi-display and the transparent panels to communicate with outside of the floor type multi-display apparatus;

the multi-display is accommodated within a recess formed in the floor; and the transparent panels are disposed in such a manner that respective top surfaces of the transparent panels are positioned coplanar with the floor.

* * * * *